United States Patent [19]

Adler

[11] 4,240,894

[45] Dec. 23, 1980

[54] DRUM FOR ELECTRODEPOSITED COPPER FOIL PRODUCTION

[76] Inventor: Edward Adler, 266 Arch Rd., Englewood, N.J. 07631

[21] Appl. No.: 82,410

[22] Filed: Oct. 5, 1979

[51] Int. Cl.[3] ..... C25D 1/04; C25D 17/12; C25D 1/20

[52] U.S. Cl. ..... 204/281; 204/208

[58] Field of Search ..... 204/13, 12, 281, 208, 204/279

[56] References Cited

U.S. PATENT DOCUMENTS

| | | | |
|---|---|---|---|
| 1,993,726 | 3/1935 | Wilkins | 204/281 X |
| 2,646,396 | 7/1953 | Dean | 204/12 |
| 3,151,048 | 9/1964 | Conley et al. | 204/181 X |
| 3,461,046 | 8/1969 | Clancy | 204/13 |
| 3,767,537 | 10/1973 | Selker | 204/281 X |
| 3,859,194 | 1/1975 | Barrett | 204/208 |

FOREIGN PATENT DOCUMENTS

| | | | |
|---|---|---|---|
| 2024112 | 12/1971 | Fed. Rep. of Germany | 204/13 |

*Primary Examiner*—Howard S. Williams
*Assistant Examiner*—D. R. Valentine
*Attorney, Agent, or Firm*—McAulay, Fields, Fisher & Goldstein

[57] ABSTRACT

A drum for copper foil production by an electrodeposition method is composed of an inner support cylinder formed of a copper alloy material having both high electrical conductivity and good elastic properties, and an outer cylinder formed of titanium, zirconium or tantalum having good stripping characteristics which has been shrunk fit to the support cylinder. The support cylinder is provided with spaced raised portions. The alloy used to form the support cylinder is also chosen to have a substantially higher coefficient of expansion than titanium, zirconium, or tantalum.

As a result of this shrink fitting process, the cylinder of titanium, zirconium or tantalum is biased into intimate contact with the raised portions only of the inner support cylinder. This effectively increases the pressure as, by reducing the interface area, the force per unit area increases.

In addition, because the production of copper foil normally involves the use of heated solutions, and because there is heating generated by the large amount of current used in copper foil production, the drum is subjected to a heating and cooling cycle during its normal operation. The differential thermal expansion of the elements of the drum will further secure the inner cylinder to the outer cylinder as the inner cylinder expands to a greater extent than the outer cylinder. This force is also effectively increased by the reduced interface area.

13 Claims, 2 Drawing Figures

DRUM FOR ELECTRODEPOSITED COPPER FOIL PRODUCTION

BACKGROUND OF THE INVENTION

The present invention relates generally to an improved drum structure for use in copper foil production by an electrodeposition method. More particularly, the present invention relates to a drum structure which uses a titanium, zirconium or tantalum outer cylinder supported on an inner support cylinder wherein problems of differential movement or slippage and of electrical resistance between the two cylinders are minimized. Energy savings and higher rates of production are realized.

Electrodeposition of copper foil is one example of the general field of electroforming which is usually defined as the production of an article of electrodeposition upon a mandrel or form from which the electrodeposit is subsequently removed. Electroforming differs from ordinary electrodeposition or electroplating coatings in that electroforms are used as separate structures, rather than as coatings to provide decorative effects or corrosion resistence or the like.

In ordinary electroplating, such as the plating of tableware or the chromium plating of automobile bumpers, and the like, good adherence of the electrodeposited coating to the substrate metal is very important. For purposes of electroforming, including the production of copper foil, it is necessary that the electrodeposited metal temporarily be adherent to the substrate—during the course of deposition only—and that the adherence be sufficiently low to allow the electrodeposited foil to be readily removed without tearing at the conclusion of the deposition process.

As is well-known, the stripping surface is an important element in the formation of copper foil by electrodeposition methods. A number of metallic stripping surfaces and procedures for processing them have been proposed over the years for promoting the easy separation or stripping of electrodeposited metals from the substrate mold or mandrel. Metals that have been used include lead, silver, aluminum, chromium, copper, stainless steel, titanium and the like. Procedures such as so-called passivation of the surfaces with chromic solutions, anodic oxidation, oiling, iodizing, graphite application and the like have been used to enhance the ease of stripping.

Thin sheet copper or copper foil has been produced by electrodeposition on appropriate surfaces, on a commercial basis for almost fifty years. Its production and usage have become increasingly important with the rapid rise in the use of printed circuits in which electrodeposited copper foil is used in large quantities.

In the electrolytic production of copper foil, a horizontal drum or cylinder is partially immersed and rotated in a copper plating solution in which the drum is made cathodic. The speed of rotation and the cathode current density are coordinated so that the desired thickness of copper foil is deposited in the time the drum is immersed in the solution during its rotation. The emerging drum surface, now clad with electrodeposited copper foil, is washed and dried and the copper foil stripped from the surface and wound up in continuous lengths on an auxiliary roll.

The continuous production of electrodeposited copper foil and the continuous rotation of drums required therefor, makes copper foil production one of the more difficult examples of electroforming, especially with regard to the maintenance of the surface stripping layer and the continued reliability of said stripper layer in its function as a substrate for the electrodeposited metal to be repetitively stripped therefrom. As a result of these difficulties, only a few metals have been successfully used as drum working or stripping surface layers in the commercial production of electrodeposited copper foil.

Lead surface sheets were used for a number of years. Lead sheets 1¼ inches thick by 64 inches wide and 22 feet long, for example, were wrapped around lead wheels cast onto a copper sleeved shaft. The lead sheet was seamed and then fusion bonded to the wheels. Although this made a strong structural tie and also good electrical contact, for adequate stripping purposes it was found necessary to continuously polish the lead surface, in effect exposing a freshly polished lead surface for each rotation into the solution and electrodeposition of foil. This resulted in the production of a large amount of toxic lead powder. In addition, lead particles sometimes broke away from the surface and were incorporated into the surface of the copper foil from the drum. As soon as better surfaces were developed, lead drums were generally abandoned.

Stainless steel was proposed as a surface layer for copper foil production as long ago as the 1930's. However, it was not until about 1958 that large stainless steel drums were successfully used for commercial production of electrodeposition.

Stainless steel has advantages as a stripping surface, as follows:

1. It usually does not require continuous polishing and does not break away to be incorporated into the copper foil; and
2. It can be joined to itself to make an excellent seam and, by brazing or welding, to steel or copper wheels for forming good electrical and mechanical bonding thereto.

However, stainless steel has the disadvantage that it is severely corroded when subject to electrochemical anodic action which occurs as a result of back EMF developed when power failure or other interruption in the applied direct current takes place. Stainless steel is presently used commercially as a drum surface layer, either by itself or with a chromium plated top surface, because of some advantages over previous surfaces.

Titanium was also proposed as a stripping surface for electroforming and is the subject of U.S. Pat. No. 2,646,391 issued in the name of Reginald S. Dean. Although titanium has been commercially used for stripping surfaces in such applications as starter cathode sheets in electrolytic zinc, maganese and copper refining, its high cost and poor electrical conductivity and especially the difficulty of making non-brittle welds between titanium and other metals, are disadvantages in the use of titanium for forming electrodeposition drums for use in copper foil production.

Early commercial attempts (1956) to avoid disadvantages of titanium with respect to its ability to be welded to other materials included wrapping titanium into a cylinder around a lead supporter drum. The resulting drum initially produced copper foil of good quality, except at the seams, as the welding thereat was defective. However, after some weeks of operation, difficulties were experienced: several hot spots developed and the titanium surface sheet showed evidence of separation from the support drum.

Another procedure was employed more recently by a Japanese Company in which a titanium cylinder was heat shrunk on to a mild carbon steel support structure. A number of these drums were put into production in Japan. Mild carbon steel was chosen for its strength coupled with acceptable electrical conductivity properties. The technique used to form the drum was basically to prepare a titanium cylinder of such dimensions that when heated and superimposed upon the inner steel drum, it would shrink and develop a substantial gripping force to hold the titanium cylinder on the steel drum. In some cases forces of about 540 tons are developed across the drum cylinder interface Steel was used for the support drum to insure that it would withstand forces of this magnitude. Because mild steel cannot withstand attack by copper sulphate-sulphuric acid electrolyte normally used in copper foil production, it was necessary to cover the ends of the steel drum as well as the outer surfaces.

Although slippage was minimized it was found that, in spite of the large forces created by the shrink fit mode of construction, the titanium layer may move with respect to the drum, after a period of use. When this occurs, it frequently results in the tearing of the protective sides and the leakage of electrolyte through the outer enclosure to attack the steel drum. In addition, because of the movement between the surfaces, "hot spots" were experienced occasionally on the titanium surface. These are not attributed to the separation of titanium from contact with the steel support drum, leading to higher currents and heating in adjacent areas which were still in contact. Such drums are therefore limited with respect to the current which can be used and accordingly to the rate of production of copper foil.

As is readily realized, the effect of separation of the outer cylinder from the support drum becomes greater as the amount of current flowing through the drum increases. Thus, these drums not only have the disadvantage of eventual physical failure and attack by electrolyte, but are limited by the amount of current that they carry and hence to the rate of production of copper foil.

It is a general object of the present invention to provide an improved drum construction for the electrodeposition of copper.

It is a more specific object of the present invention to provide a titanium, zirconium or tantalum covered drum which avoids the disadvantages of prior art drums.

BRIEF DESCRIPTION OF THE INVENTION

Briefly, the present invention is in the construction of a support drum formed of an alloy which has good electrical conductivity, a higher index of thermal expansion than titanium, vanadium or tantalum, and relatively good elastic properties, to support a titanium, vanadium, or tantalum cylinder heat shrunk thereover. The surface of the support drum is grooved to reduce the area of surface in contact with the outer layer and hence to improve the contact therewith.

The resulting drum structure is capable of handling currents up to twice or more times that of the prior art structures and is free of the disadvantages of the prior art.

DESCRIPTION OF THE PREFERRED EMBODIMENT

Figure 1:
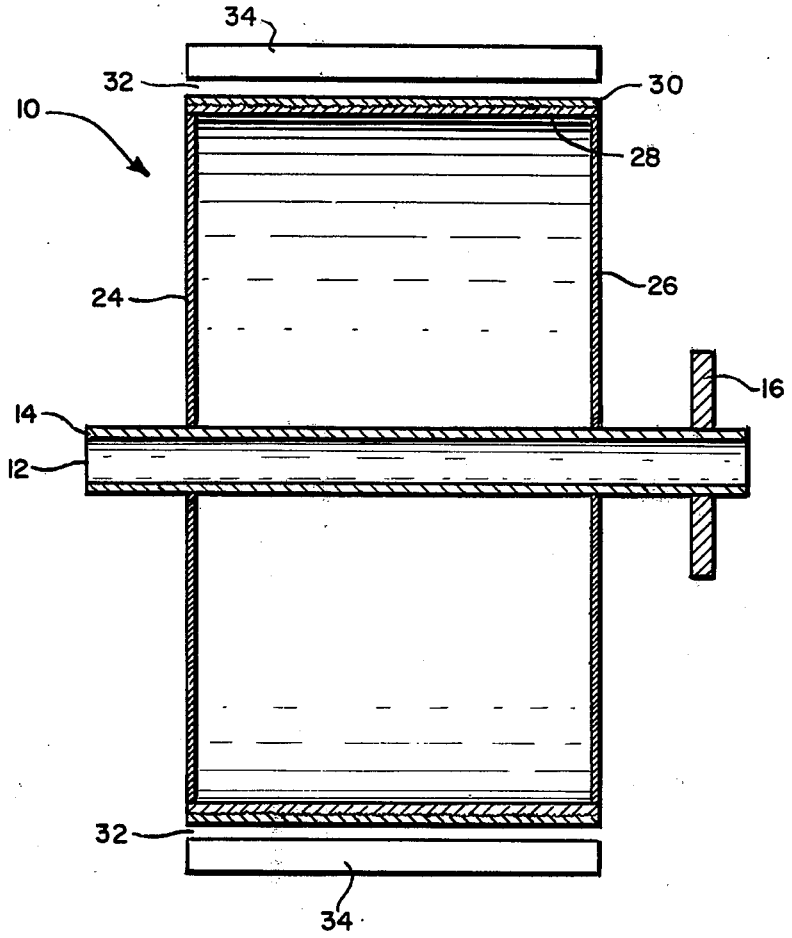
FIG. 1 is a horizontal view of a drum structure according to the present invention.

With reference to FIG. 1, a drum 10 is formed with a steel shaft 12 which is supported and rotated by ususal devices (not shown). A copper sleeve 14 is provided on the steel shaft 12 to impart the good current carrying characteristics necessary for carrying the high currents used in copper production.

Current is provided to the drum through a copper contact slip ring 16 which is secured around and in electrical contact with the copper sleeve 14. As the drum rotates, the contact ring 16 similarly rotates in a well formed in a copper contact block in which is contained a pool of mercury (not shown). Direct current is applied by a heavy bus bar to the contact block. This method of providing current to the drum is described only generally as it is well-known in the art. Any other suitable method may be employed. If necessary, multiple contact blocks and pools of mercury can be provided.

DC current can be provided by any usual source (not shown) such as a rectifier or generator.

Wheels 24, 26 are provided at spaced apart positions on shaft 12 and in electrical contact with copper sleeve 14, to support inner support cylinder 28 and provide electrical current thereto.

Figure 2:
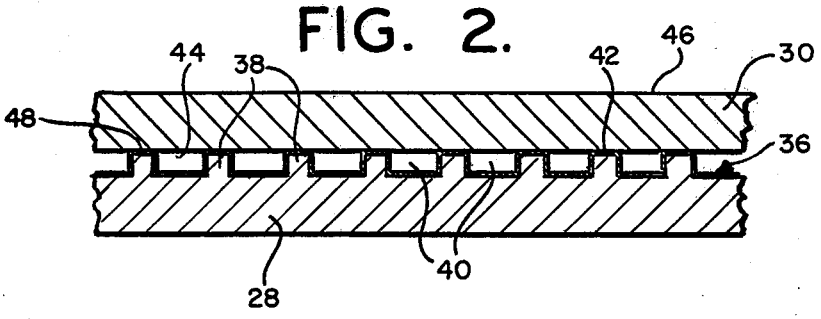
FIG. 2 is an enlarged partial view of the drum structure showing the interface between the support cylinder and the stripping surface cylinder.

Encircling inner support cylinder 28 is a stripping surface cylinder 30 (see also FIG. 2).

Also schematically shown in FIG. 1 is electrolyte pool 32 and anode 34, in order to illustrate their proximity in relationship to the drum during normal operation. The drum is normally only about 45% submerged in electrolyte.

The stripping surface cylinder 30 can be made of titanium, zirconium, or tantalum, or alloys thereof. The use of various zirconium and titanium alloys, such as the alloys disclosed in Dean U.S. Pat. No. 2,646,396, as useful for stripping surfaces, can be employed herein. Chemically pure titanium (CP titanium) is preferable for use over its alloys because it has good corrosion resistance and electrical conductivity. In addition, the working of CP titanium is easier as it is malleable and forms a smoother weld. The thickness of the stripping surface cylinder 30 is preferably between two millimeters and ten millimeters, most preferably about six to eight millimeters. A cylinder made of material much thinner than two millimeters may be subject to distortion as a result of the unique structure used for the surface of the inner support cylinder 28 as will be discussed in detail below. A stripping surface cylinder 30 of much greater than ten millimeters in thickness will be unnecessarily expensive because of the unnecessary extra titanium needed to form it. In addition, as titanium has less than ideal electrical conductivity characteristics, the excessive thickness will add extra electrical resistance, causing unnecessary inefficiency in current usage due to Joule heating loses. Six millimeters thickness provides good strength and acceptable electrical conductivity for use in the present invention.

The inner support cylinder is composed of copper or a copper alloy having electrical conductivity greater than about 70% International Annealed Copper Standard (IACS)—that is compared with pure annealed copper. This electrical conductivity requirement is balanced against the advantages of having greater elasticity or strength in the copper alloy, as will be obvious from the discussion below. Thus, a copper alloy containing small amounts of tin, that is a low tin bronze alloy, preferably containing small amounts of phosphorous, as a "deoxidizing" agent, is of the type of material from which the inner support cylinder is preferably made. Such bronze alloys as phosphorous deoxidized copper containing up to about 0.03% phosphorous, up to about 0.5% tin, and the rest copper, have been found particularly suitable. An example of such an alloy which has been found effective for use in the inner support cylinder 28, contains about 0.41% tin; 0.027% phosphorous, and the rest copper. This alloy has a measured electrical conductivity of about 85% (IACS).

With reference to FIG. 2, the outer surface of inner support drum 28, is machined, or otherwise worked to form a grooved surface 36. Typically, the grooved surface 36 comprises raised portions 38 with valleys 40 formed therebetween. The raised portions are preferably formed on 5 millimeter centers with valleys which extend 3.5 millimeters in width. Thus, the raised portions extend about 1.5 millimeters in width and preferably have substantially flat tops 42. This reduces the effective area of support drum surface 36 which is in contact with and supports stripping surface cylinder 30.

The depth of the valleys 40 is preferably in the range of 0.1 to 0.5 millimeters, most preferably about 0.3 millimeters. 0.3 millimeters depth is sufficient to prevent the bottom of the valleys 40 from contacting the inner surface 44 of stripping cylinder 30, even under the forces generated by shrink fit assembly of the drum 10. It is undesirable to make the valley 40 much deeper than 0.5 millimeters, as the raised portions 38 must carry all of the current from the body of the support cylinder 28 to the stripping surface cylinder 30. Thus keeping raised portions 38 as low as practical will minimize the electrical pathway therethrough—and therefor their resistance. The raised portions represent a smaller total area than would be present if the outer surface 36 of the support cylinder 28 were not grooved, and therefor they carry a higher current density. With the preferred embodiment discussed above, having 3.5 millimeter valleys and 1.5 millimeter wide raised portions, the raised portions present only about 30% of the area of surface 36 that they would present if surface 36 were not grooved, and therefor must carry more than three times the current density.

In order to provide a strong mechanical and good electrical interface between the stripping surface cylinder 30 and the inner support cylinder 28, the stripping surface cylinder 30 is preferably shrink fitted to the inner support cylinder 28.

Using usual shrink fitting techniques to assemble drums in this field, a two millimeter shrink is applied to a usual drum size. With a 92 inch diameter drum, and a face width of about 53 inches, the stripping surface cylinder 30 is heated to about 450° Fahrenheit, slipped over the inner support cylinder 28, and allowed to cool. Because the stripping surface cylinder 30 contacts only the raised portions 38, the pressure (force/area) generated by employing usual shrink fitting techniques is more than tripled. This is because the raised portions comprise only about 30% of the surface of the drum. There is some seizing of the inner surface 44 of the stripping surface cylinder, which further operates to prevent slippage of the stripping surface cylinder 30 with respect to the inner support cylinder 28. As was discussed above, when using a stripping surface cylinder of much less than two millimeters in thickness, there is the possibility that the impression of the valleys 40 and raised portions 38 will carry through to the working surface 46 and possibly adversely affect the copper foil production process.

A further advantage to the use of copper or copper alloys for the inner support cylinder 28 and the wheels 24, 26 is the relatively high coefficient of thermal expansion (cm/cm/°C.) characteristic of copper and its alloys, when compared with that of titanium, zirconium, or tantalum. Thus, for example, titanium has a coefficient of thermal expansion of $8.5\times10^{-6}$ per degree centigrade, zirconium has a coefficient of thermal expansion of $5\times10^{-6}$ per degree centigrade and tantalum has a coefficient of thermal expansion of $6.7\times10^{-6}$ per degree centigrade, while copper and copper alloys retaining at least 70% electrical conductivity (IACS) hava a coefficient of thermal expansion typically about $18\times10^{-6}$ per degree centigrade.

Because of this differential thermal expansion of the inner support cylinder 28 and wheels 24, 26 with respect to the stripping surface cylinder 30, and in particular because the inner support surface cylinder 28 expands to a greater extent than the stripping surface cylinder, as the drum 10 is rotated through the hot electrolyte and as the drum is supplementally heated due to Joule heating, stripping surface cylinder 30 is biased into even tighter abutment with support cylinder 28. This further reduces the possibility of slippage.

A still further advantage to the use of copper for inner support cylinder 28 and wheels 24, 26 is the relatively good elastic properties (e.g. modulus of elasticity) of copper and copper alloys. Elastic properties at least similar to those of the stripping surface cylinder have been found adequate to ensure that in repeated cycles of expansion and contraction due to rotation into and out of the hot electrolyte, the inner support cylinder 28 is not stressed beyond its elastic limit and therefore maintains good contact with the outer cylinder.

It was calculated that the prior art (Japanese) shrink fit drum, which was shrink fitted using a stripping surface drum with an inside diameter of about two millimeters less than the outer diameter of the support cylinder 28 (or six millimeters on the circumference) generated a biasing force of about 540 tons. However, in the present structure, because this force is borne by 30% of the surface area of the support cylinder 28, the effective pressure (force per unit area) is more than tripled. In addition, because of the differential expansion between the inner support cylinder 28 and the stripping surface cylinder 30, an elevation of about 65° Fahrenheit or so will be equivalent to an additional force of about 350 thousand pounds, again borne by 30% of the prior art surface area.

The practical result of the construction of the present invention is a drum 10 wherein the outer stripping surface cylinder 30 is firmly attached or seized to the inner support cylinder 28 so that there is no relative shifting therebetween. The formation of "hot spots" which plagued the prior art drums, is essentially eliminated. In fact, it has been found that the present invention drum 10 can be used with up to two times the current of the prior art drums without formation of hot spots.

To further assure that all raised portion top surfaces 42 contact the inner cylindrical surface of the stripping surface cylinder 30, the top surface 42 should substantially define a cylindrical surface, that is, they should all be supported substantially the same radial distance from the central axis about which the drum 10 rotates. This is preferably accomplished by turning the support cylinder 28 on a lathe, before cutting the valleys 40 into cylinder 28.

A further improvement in operation of the drum 10 can also be accomplished by providing a silver coating 48 on the flat top surface 42 of raised portion 38. As silver tarnish films have better electrical conductivity than copper tarnish films, the silver coating 48 insures minimum electrical resistance at the interface of stripper surface cylinder 30 and support cylinder 28.

While preferred embodiments of the invention have been shown and described herein, it will become obvious that numerous omissions, changes and additions may be made without departing from the spirit and scope of the present invention. Thus, for example, although the support drum surface has been disclosed as grooved, grooving was used because of the ease of machining the surface in this manner. Clearly any other pattern, or even a random substantially uniform distribution of raised portions can accomplish the same purpose of reducing the interface contact area between support cylinder and stripping surface cylinders—while still supporting the stripping surface cylinder.

What is claimed is:

1. An improved drum structure of the type having a titanium, zirconium or tantalum stripping surface formed as an outer cylinder of titanium, zirconium or tantalum heat shrunk upon an inner support cylinder, for forming copper foil by electrodeposition onto said stripping surface and subsequent stripping therefrom; comprising:

said inner support cylinder being formed with substantially at least the same elastic properties as said outer cylinder and with a substantially higher electrical conductivity and a substantially higher coefficient of thermal expansion than said outer cylinder; said inner cylinder having an outer surface provided with alternating raised portions whereby said raised portions are in intimate contact with said outer cylinder.

2. An improved drum structure with stripping surface for producing copper foil by electrodeposition and stripping methods, comprising:

an inner support structure formed of material with electrical conductivity of at least about 70% (IACS) said inner support cylinder structure having an outer surface provided with alternating raised portions;

a stripping surface cylinder formed of titanium, zirconium or tantalum, and having an inner surface, said inner surface of said stripping surface cylinder encircling and, under normal ambient temperatures, being biased against and supported on said raised outer surface of said inner support cylinder structure, thereby to make good electrical contact therebetween, and to increase the effective biasing force per unit area of contact between said inner support cylinder structure and said stripping surface cylinder;

said inner support cylinder structure having a higher coefficient of thermal expansion than said stripping surface cylinder, whereby when said drum is heated, said inner support cylinder structure expands to a greater extent than said stripping surface cylinder, to force the said raised portions on the surface of said inner support cylinder structure into intimate contact with said stripping surface cylinder, when said drum is subjected to heating.

3. The drum of claim 2, wherein said inner support cylinder structure is formed of copper or copper alloy, and said stripping surface cylinder is shrink fitted around said inner support cylinder structure.

4. The drum of claim 2 or 3, wherein said stripping surface is titanium.

5. The drum of claim 2, wherein said raised portions comprise flat topped upper surfaces in contact with said stripping surface cylinder.

6. The drum of claim 2, 3 or 5, wherein said raised portions are formed by ridges defining valleys therebetween.

7. The drum of claim 6, wherein said ridges cover about 30% of the surface area of the inner support cylinder structure.

8. The device of claim 7, wherein said ridges are about 1.5 millimeters wide and said valleys are about 3.5 millimeters wide.

9. The device of claim 7 or 8, wherein said valleys are 0.1–0.5 millimeters deep.

10. The device of claim 9, wherein said valleys are about 0.3 millimeters deep.

11. The device of claim 2, 3 or 5, further comprising a silver coating on said raised portion.

12. The device of claim 2 or 3, wherein said raised portions substantially define a cylindrical surface.

13. The device of claim 2, wherein said inner support cylinder structure comprises side wheels formed of a metal comprising mainly copper.

* * * * *

UNITED STATES PATENT AND TRADEMARK OFFICE

CERTIFICATE OF CORRECTION

PATENT NO. : 4,240,894

DATED : 23 December 1980

INVENTOR(S) : Edward Adler

It is certified that error appears in the above—identified patent and that said Letters Patent is hereby corrected as shown below:

Column 3, line 29, "not" should read --now--.

Signed and Sealed this

*Seventh* Day of *April 1981*

[SEAL]

*Attest:*

RENE D. TEGTMEYER

*Attesting Officer* *Acting Commissioner of Patents and Trademarks*